US008613820B2

(12) United States Patent
Smeyers et al.

(10) Patent No.: US 8,613,820 B2
(45) Date of Patent: Dec. 24, 2013

(54) STRUCTURAL AUTOMOTIVE PART MADE FROM AN AL—ZN—MG—CU ALLOY PRODUCT AND METHOD OF ITS MANUFACTURE

(75) Inventors: Axel Alexander Maria Smeyers, Heist op den Berg (BE); Bruno Schepers, Brasschaat (BE); Sabine Maria Spangel, Koblenz (DE); Alastair Wise, VC Santpoort-Noord (NL); Ingo Günther Kröpfl, Polch (DE); Sunil Khosla, Beverwijk (NL)

(73) Assignees: Aleris Aluminum Duffel BVBA, Duffel (BE); Aleris Aluminum Koblenz GmbH, Koblenz (DE)

( * ) Notice: Subject to any disclaimer, the term of this patent is extended or adjusted under 35 U.S.C. 154(b) by 0 days.

(21) Appl. No.: 13/318,233

(22) PCT Filed: Jun. 1, 2010

(86) PCT No.: PCT/EP2010/057660

§ 371 (c)(1),
(2), (4) Date: Dec. 15, 2011

(87) PCT Pub. No.: WO2010/142579

PCT Pub. Date: Dec. 16, 2010

(65) Prior Publication Data

US 2012/0090742 A1 Apr. 19, 2012

(30) Foreign Application Priority Data

Jun. 12, 2009 (EP) ..... 09162616

(51) Int. Cl.
*C22F 1/053* (2006.01)
*C22C 21/10* (2006.01)

(52) U.S. Cl.
USPC ..... 148/701; 148/417

(58) Field of Classification Search
USPC ..... 148/417, 701
See application file for complete search history.

(56) References Cited

U.S. PATENT DOCUMENTS

| | | | | |
|---|---|---|---|---|
| 4,424,084 | A * | 1/1984 | Chisholm | 148/417 |
| 2001/0046561 | A1 * | 11/2001 | Held et al. | 427/316 |
| 2005/0189044 | A1 | 9/2005 | Benedictus et al. | |
| 2008/0173377 | A1 | 7/2008 | Khosla et al. | |

FOREIGN PATENT DOCUMENTS

| | | | | |
|---|---|---|---|---|
| JP | 05043970 | A * | 2/1993 | C22C 21/00 |
| WO | 2007009616 | A1 | 1/2007 | |

OTHER PUBLICATIONS

Machine translation of JP 05043970, 1993.*
International Search Report from PCT/EP2010/057660 dated Jul. 28, 2010.
Wikipedia, URL < http://en.wikipedia.org/wiki/Body_in_white>; retrieved from the internet Oct. 31, 2011.

* cited by examiner

*Primary Examiner* — Rebecca Lee
(74) *Attorney, Agent, or Firm* — Novak Druce Connolly Bove + Quigg LLP

(57) ABSTRACT

A method of manufacturing a formed aluminum alloy body-in-white ("BIW") part of a motor vehicle, the BIW part having a yield strength of more than 500 MPa after being subjected to a paint-bake cycle. The method includes (a) providing a rolled aluminum sheet product of an AlZnMgCu alloy and having a gauge in a range of 0.5 to 4 mm and subjected to a solution heat treatment (SHT) and quenched following SHT, and wherein the SHT and quenched aluminum sheet product has a substantially recrystallized microstructure, (b) forming the aluminum alloy sheet to obtain a formed BIW part, (c) assembling the formed BIW part with one or more other metal parts to form an assembly forming a motor vehicle component, (d) subjecting the motor vehicle component to a paint bake cycle, wherein the aluminum alloy sheet in the formed BIW part has a yield strength of more than 500 MPa.

16 Claims, No Drawings

STRUCTURAL AUTOMOTIVE PART MADE FROM AN AL—ZN—MG—CU ALLOY PRODUCT AND METHOD OF ITS MANUFACTURE

CROSS-REFERENCE TO RELATED APPLICATIONS

This application is a §371 National Stage Application of International Application No. PCT/EP2010/057660, filed on 1 Jun. 2010, claiming the benefit of European Patent Application No. 09162616.8 filed on 12 Jun. 2009.

FIELD OF THE INVENTION

The invention relates to a method of manufacturing a formed aluminium alloy structural part or body-in-white (BIW) part of a motor vehicle, the BIW part having a yield strength of more than about 500 MPa after being subjected to a paint-bake cycle.

BACKGROUND TO THE INVENTION

As will be appreciated herein below, except as otherwise indicated, aluminium alloy designations and temper designations refer to the Aluminum Association designations in Aluminum Standards and Data and the Registration Records, as published by the Aluminum Association in 2009.

For any description of alloy compositions or preferred alloy compositions, all references to percentages are by weight percent unless otherwise indicated.

In the production of motor vehicles in particular aluminium alloys the AA5xxx- and AA6xxx-series alloys like 5051, 5182, 5454, 5754, 6009, 6016, 6022, and 6111, have been used to produce body panels and structural parts or body-in-white ("BIW") parts.

There is a demand for the use of aluminium alloys, in particular for formed BIW parts, which are formable and having increased strength after being subjected to a paint bake cycle. Typical targets for the mechanical properties are a yield strength or Rp0.2 of over 500 MPa after the paint bake cycle. In addition, the properties normally required for BIW parts include:

a high formability for the forming operation, typically by means of stamping, deep drawing, or roll forming, high mechanical strength after paint baking so as to enabling down gauging thus minimising the weight of the part, good behaviour in the various assembly methods used in motor vehicle manufacturing such as spot welding, laser welding, laser brazing, clinching or riveting, and an acceptable cost for mass production.

SUMMARY OF THE INVENTION

It is an object of the present invention to provide a method of manufacturing formed BIW parts having after the paint bake cycle a yield strength of over 500 MPa.

It is another objet of the invention to provide rolled aluminium alloy sheet products that can be used in this method.

These and other objects and further advantages are met or exceeded by the present invention providing for a method of manufacturing a formed aluminium alloy body-in-white ("BIW") part of a motor vehicle, the BIW part having a yield strength of more than 500 MPa after being subjected to a paint-bake cycle, and wherein the method comprises the sequential steps of:

a. providing a rolled aluminium sheet product having a gauge in a range of about 0.5 to 4 mm, and preferably in a range of about 0.7 to 3.5 mm, and being subjected to a solution heat treatment ("SHT") and having been quenched following said SHT, and wherein the SHT and quenched aluminium sheet product has a substantially recrystallised microstructure, and a chemical composition of, in weight percent, Zn 6.9% to 8.0%
Mg 1.2% to 2.4%
Cu 1.3% to 2.4%
Mn<0.3%
either 0.05% to 0.25% of Cr or Zr,
Si<0.3%
Fe<0.35%
Ti<0.1%,
impurities and others each <0.05%, total <0.2%, and balance aluminium;

b. forming the aluminium alloy sheet to obtain a formed BIW part, in particular forming by means of deep-drawing, pressing or press forming;

c. assembling the formed BIW part with one or more other metal parts to form an assembly forming a motor vehicle component;

d. subjecting said motor vehicle component to a paint bake cycle and wherein the aluminium alloy sheet in the formed BIW part has a yield strength of more than 500 MPa, and in the best example of about 540 MPa or more.

In order to have good formability characteristics the rolled SHT and quenched aluminium sheet should have a substantially recrystallised microstructure, meaning that 70% or more, and preferably about 85% or more of the grains in this condition are recrystallised. A recrystallised microstructure is believed result in a more isotropic microstructure important for obtaining a good formability. The skilled person is familiar with the required processing to arrive at such a sheet product having such a microstructure. The quenched aluminium sheet can be stretched for up to about 5% or levelled as is known in the art. It has been found that this recrystallised microstructure in the sheet product is maintained during subsequent natural ageing, any optional or preferred heat treatment according to this invention, forming operation and paint baking.

The rolled aluminium alloy sheet has a chemical composition, in wt. %:

Zn 6.9% to 8.0%, preferably about 6.9% to 7.8%,
Mg 1.2% to 2.4%, preferably about 1.4% to 2.1%,
Cu 1.3% to 2.4%, preferably about 1.4% to 1.8%,
Mn<0.3%, preferably <0.25%,
either 0.05% to 0.25% of Cr or Zr,
Si<0.3%, preferably about 0.1% to 0.25%,
Fe<0.35%, preferably about 0.1% to 0.25%,
Ti<0.1%,
inevitable impurities and others each<0.05%, total<0.2%, and balance aluminium.

Together with the microstructure in the sheet product, the chemical composition, with defined preferred narrower ranges, of the sheet product is essential to arrive at a formable product with high mechanical properties after paint baking.

With the exception of the higher permissible Si- and Fe-level this aluminium alloy in its broad definition encompasses the AA7081 and AA7085-series aluminium alloys. Where these are known for structural parts of aerospace vehicles, it has been found that when these are used in the form of sheet products for structural parts of motor vehicles, a higher Si and Fe-content can be tolerated without adversely affecting the relevant engineering properties for these applications, in particular strength after paint baking.

In a preferred embodiment Zr is present as a mandatory alloying element in a range of 0.04% to 0.25%, and more preferably in a range of about 0.07% to 0.18%. The addition of Zr is preferred over the addition of Cr.

Ti can be added to the alloy product amongst others for grain refiner purposes during casting of the alloy stock, e.g. ingots or billets. The addition of Ti should not exceed 0.1%. A preferred lower limit for the Ti addition is about 0.01%. Ti can be added as a sole element or with either boron or carbon serving as a casting aid, for grain size control.

As known in the art 7000-series alloy products may optionally further comprise at most about 0.05% Ca, at most about 0.05% Sr, and/or at most about 0.004% Be. Traditionally, beryllium additions have served as a deoxidizer/ingot cracking deterrent and may be used in the alloy product according to this invention. Though for environmental, health and safety reasons, more preferred embodiments of this invention are substantially Be-free. Minor amounts of Ca and Sr alone or in combination can be added to the alloy product for the same purposes as Be. Preferred addition of Ca is in a range of about 10 to 100 ppm.

Following SHT and quenching the sheet product can be formed into a shaped BIW part of a motor vehicle. Before shaping, the sheet may be coated with a lubricant, oil or dry lubricant, suitable for the forming operation, the assembly and the surface treatment of the structural part to be produced. The sheet may also be treated to apply a surface passivation layer to enhance adhesive bonding performance.

As the SHT and quenched sheet is in an instable condition due to the occurrence of a spontaneous natural ageing effect at ambient temperature (in the art also referred to a W-condition), preferably the time between the quenching operation and the forming operation is less than 2 weeks and more preferably less than 4 days. Immediately after the quenching operation the rolled sheet product has typically a yield strength of about 180 to 235 MPa and should be formed to a BIW part before it reaches a yield strength of about 400 MPa. At such yield strength levels the alloy sheet product may still be formed by means of roll forming or bending.

More preferably the solution heat treated and quenched sheet product is artificially aged to peak strength or near peak strength or slightly over-aged, typically an T6 or T7 temper. In this condition the sheet product has a very high strength (and in the best examples of 540 MPa or more) combined with a relatively high Rp/Rm ratio, and can be formed, typically by means of roll forming, into a structural component. The formed structural component is made part of an assembly of other metal components as regular in the art for manufacturing vehicle components, and subjected to a paint bake operation to cure any paint or lacquer layer applied. In accordance with the invention it has been found that the paint bake operation does not result in any substantial loss in strength in the roll formed component when it has been artificially aged prior to the forming operation. After the paint bake operation a yield strength of more than 500 MPa, and preferably of more than 540 MPa is maintained.

For those forming operations which require significant or strong deformation of the sheet product, for example by means of drawing or stamping, it is preferred that after storage and prior to the forming operation the sheet product as a whole is subjected to a heat treatment wherein it is soaked for a period of 3 sec. to 15 min, and preferably less than 10 min. at a temperature in a range of about 400° C. to 490° C., and preferably 450° C. to 480° C., and then rapidly cooled or quenched, for example by means water such as water quenching or water spray quenching. It has been found that such a very short heat treatment facilitates the forming of the sheet product into a formed product. This short heat treatment should be carried out less than about 8 hours prior to the forming operation of the sheet product, and preferably less than about 1 hour. This heat treatment can be carried out in or near the press shop on coiled material and then re-coiled and cut for forming, or it can be cut to blanks from the coil or strip then heat treated and subsequently formed.

Following the forming operation the forming BIW part is made part of an assembly of other metal components as regular in the art for manufacturing vehicle components, and subjected to a paint bake operation to cure any paint or lacquer layer applied. The paint bake operation or cycle comprises one or more sequential short heat treatment in the range of 140° C. to 190° C. for a period of 10 to less than 40 minutes, and typically of less than 30 minutes. A typical paint bake cycle would comprise a first heat treatment of 180° C.@20 minutes, cooling to ambient temperature, then 160° C.@20 minutes and cooling to ambient temperature. In dependence of the OEM such a paint bake cycle may comprise of 2 to 5 sequential steps and includes drying steps, but either way the cumulated time at elevated temperature (100° C. to 190° C.) of the aluminium alloy product is less than 120 minutes.

In accordance with the invention it has been found that following the paint bake cycle the aluminium alloy on the formed BIW part reaches a desirable yield strength of more than 500 MPa, and in the best example of 540 MPa or more, for example a yield strength of about 550 MPa or about 565 MPa.

Such high yield strength levels are comparable to the strength levels obtained in the T6-type (peak aged) and T76 or T77-type conditions for the type of aluminium alloy used in aerospace applications. However, T6-type and T7-type conditions are commonly obtained after artificial ageing for several hours, for example a two-step artificial ageing treatment of 5 hrs@120° C. then heated for 9 hrs@165° C. without intermediate cooling to ambient temperature, and followed by quenching.

Thus it has been found that the rolled aluminium alloy product used in the method according to this invention has a very strong and favourable paint bake response, such that they can be formed into a BIW part while having relatively low yield strength, while the aluminium alloy product reaches very high yield strength after the paint bake cycle. This strong paint bake response in manufacturing formed BIW parts from AlZnMgCu sheet products has so far not been recognised in the art.

Such high yield strength levels after the paint bake allow for the design for thinner parts compared to similar part made from the known 5000- and 6000-series alloys commonly used in structural automotive application. Alternatively or in addition thereto, the 7000-series alloys when processed in accordance with the invention may replace BIW parts currently made from high strength steels leading to considerable weight saving opportunities in the motor vehicle.

In an embodiment of the formed BIW part the defined 7000-series aluminium alloy a clad layer material applied on at least one side of the core material, the clad layer material having an inner-surface and an outersurface and wherein the inner-surface is facing the 7000-series material, and wherein the clad layer material consists of an AA5xxx-series alloy having more than 3.8 wt. % of Mg. More preferably the clad layer material has more than 4.8% of Mg, and preferably less than 7%, and more preferably less than 5.9%.

The clad layer has typically a thickness in a range of 2% to 30%, and preferably in a range of 3% to 20%, of the thickness of the defined 7000-series material.

In a more preferred embodiment the clad layer material is an AA5xxx-series alloy having, in wt. %:

Mg 3.8% to 7.0%, preferably 4.8 to 5.9%,
Zn 0.6% to 2.8%
Mn 0 to 1.0%
Cu 0 to 2.0%,
optionally at least one element selected from the group consisting of:
(Zr 0.04 to 0.3%, Cr 0.04 to 0.3%, Hf 0.04 to 0.3%, Ti0.01 to 0.2%),
Fe max. 0.3%
Si max. 0.3%,
inevitable impurities, balance aluminium, and whereby the range for the Zn-content is a function of the Mg-content according to:
lower-limit of the Zn-range: [Zn]=0.34[Mg]−0.4, and
upper-limit of the Zn-range: [Zn]=0.34[Mg]+0.4.

With the application of the clad layer in particular the characteristics for the pretreatment like phosphating, passivation or alternative processes used at OEM's are improved. Aluminium alloys of the 5xxx-series are known to the automotive industry and having a 5xxx-series alloy as outersurface results in that there are little or no adjustments required for the surface pretreatment of the composite structure compared to aluminium alloys already in use for automotive applications. Hence there are no problems with existing alloy systems. Another advantage of the composite structure is it can be used for making components having a high impact resistance or good crash performance. The application of an AA5xxx-series clad layer having a high Mg-content results in a favourable formation of less cracks at the surface as these alloys have a good bendability, while the defined 7xxx-series core alloy provides the required high strength.

The embodiment with the purposive addition of Zn to the clad layer material improves the compatibility with the defined AA7xxx-series material when manufacturing the composite rolled material, for example by means of roll bonding Furthermore, the addition of Zn improves the corrosion resistance of the clad layer material. A further advantage of adding Zn in these ranges is that it provides some paint-bake response leading to no loss of strength in the cladding after a paint process. The combined addition of high levels of Mg and Zn provides also an increased strength to the clad layer, and consequently contributing to the overall strength of the composite material.

In a further aspect of the invention it relates to a formed aluminium alloy BIW part having a gauge in a range of 0.5 to 4 mm, preferably in a range of about 0.7 to 3.5 mm, and having a substantially recystallised microstructure, and a yield strength of more than 500 MPa, preferably of more than about 540 MPa, after being subsequently solution heat-treatment, quenched, formed, and subjected to a paint bake cycle, and wherein the aluminium alloy has a composition, in wt. %:

Zn 6.9% to 8.0%, preferably 6.9% to 7.8%,
Mg 1.2% to 2.4%, preferably 1.4% to 2.1%
Cu 1.3% to 2.4%, preferably 1.4% to 1.8%
Mn<0.3%
either 0.05% to 0.25% of Cr or Zr,
Si<0.3%
Fe<0.35%
Ti<0.1%,
impurities and others each<0.05%, total<0.2%,
balance aluminium.

In a preferred embodiment of the formed aluminium alloy BIW part prior to the forming operation the sheet product as a whole is subjected to a heat treatment wherein it is soaked for a period of 3 sec. to 15 min., preferably for 3 to 10 min., at a temperature in a range of 400° C. to 490° C., and preferably 450° C. to 480° C., and then rapidly cooled or quenched, for example by means water such as water quenching or water spray quenching.

Due to this high strength, good formability and low weight, the BIW part according to this invention is an ideal candidate to replace parts made from dual-phase steel like steel grades dp600 and dp800, and boron steels.

In a further aspect of the invention it relates to the use of an aluminium alloy sheet in a formed structural automotive part or BIW part, and having a gauge in a range of about 0.5 to 4 mm, and preferably in a range of about 0.7 to 3.5 mm, and having a chemical composition of, in weight percent, Zn 6.9% to 8.0%, preferably 6.9% to 7.8%,
Mg 1.2% to 2.4%, preferably 1.4% to 2.1%
Cu 1.3% to 2.4%, preferably 1.4% to 1.8%,
Mn<0.3%, preferably <0.25%,
either 0.05% to 0.25% of Cr or Zr, preferably 0.07% to 0.15% Zr
Si<0.3%
Fe<0.35%
Ti<0.1%,
Inevitable impurities and others each <0.05%, total <0.2%, and balance aluminium, and preferably having a substantially recystallised microstructure, and a yield strength of more than 500 MPa, preferably of more than about 540 MPa, after being subsequently solution heat-treatment, quenched, formed, and subjected to a paint bake cycle.

In another aspect of the invention it relates to a motor vehicle incorporating a formed aluminium alloy BIW part in accordance with this invention.

In the following, the invention will be explained by the following non-limitative example.

EXAMPLE

On an industrial scale 2 mm sheet having a chemical composition within the ranges of AA7081 has been manufactured and which has been SHT for 30 min. at 475° C. and quenched. The aluminium sheet has a fully recrystallised microstructure. Within 1 hour after quenching the mechanical properties had been determined, and the Rp was 209 MPa, Rm was 369 MPa and the uniform elongation Ag was 21.4% (Condition 1).

After 2 weeks storage at room temperature the Rp increased in 352 MPa (Condition 2). But by heat treating the stored aluminium sheet for 5 minutes at 475° C., the Rp decreased to 214 MPa, the Rm decreased to 373 MPa and the uniform elongation Ag was 21.2% (Condition 3). This experiment shows that natural ageing of the SHT and quenched aluminium sheet increases the mechanical properties, but which can be decreased to almost its original set of properties via a short heat treatment, whereafter the aluminium sheet is very good formable to BIW parts.

In another experiment to SHT and quenched aluminium sheet had been artificially aged to a T6 temper by holding it for 24 hours at 120° C., resulting in an Rp of 580 MPa (Condition 4), and can for example be roll formed to BIW parts.

The sheet material in Conditions 3 and 4 had also been subject to a simulated 3 step paint bake cycle consisting of a first treatment of 20 min at 180° C., air cooled to room temperature, followed by a second treatment of 20 min at 160° C., air cooled to room temperature, and then followed by a third treatment of 20 min at 140° C. followed by air cooling to room temperature.

The sheet material in Condition 3 had after the simulated paint bake cycle an Rp of 559 MPa, and an Rm of 583 MPa, illustrating that a favourable rapid increase in strength is obtained after being subjected to a paint bake cycle.

The sheet material in Condition 4 had after the simulated paint bake cycle an Rp of 579 MPa, illustrating that when the sheet material prior to forming is at peak strength or at near peak strength it does not loose much of its original yield strength following a paint bake cycle, but instead the strength levels are maintained at a desirable high level.

All tensile properties had been measured at ambient temperature in accordance with norm EN10002-1.

Having now fully described the invention, it will be apparent to one of ordinary skill in the art that many changes and modifications can be made without departing from the spirit or scope of the invention as herein described.

The invention claimed is:

1. Method of manufacturing a formed aluminium alloy body-in-white (BIW) part of a motor vehicle, the BIW part having a yield strength of more than 500 MPa after being subjected to a paint-bake cycle, the method comprising:

a. providing a rolled aluminium sheet product having a gauge in a range of 0.5 to 4 mm and comprising an aluminum alloy being subjected to a solution heat treatment (SHT) and having been quenched following said SHT, and stored, wherein the whole aluminium alloy sheet after storage and within 10 hours prior to the forming operation is subjected to a further heat treatment wherein it is soaked for a period of 3 seconds to 10 minutes at a temperature in a range of 400° C. to 490° C. and then rapidly cooled or quenched, and wherein the SHT and quenched aluminium alloy of the sheet product has a substantially recrystallised microstructure, and a chemical composition of, in weight percent, Zn 6.9 to 8.0,
Mg 1.2 to 2.4,
Cu 1.3 to 2.4,
Mn<0.3,
either 0.05 to 0.25 of Cr or Zr,
Si<0.3,
Fe<0.35,
Ti<0.1,
impurities and others each <0.05, total <0.2, balance aluminium, b. forming the aluminium alloy sheet to obtain a formed BIW part, c. assembling the formed BIW part with one or more other metal parts to form an assembly forming a motor vehicle component;

d. subjecting said motor vehicle component to a paint bake cycle, wherein the paint bake cycle comprises at least one heat treatment of holding the assembly forming the motor vehicle component at a temperature in a range of 140° C. to 190° C. for a period of 10 to less than 40 minutes, and wherein the aluminium alloy sheet in the formed BIW part has a yield strength of more than 500 MPa.

2. Method according to claim 1, wherein the aluminium alloy has Zr in a range 0.04% to 0.25%.

3. Method according to claim 1, wherein the aluminium alloy has a Cu content in a range of 1.4% to 1.8%.

4. Method according to claim 1, wherein the whole aluminium alloy sheet within 8 hours prior to forming in step b. has been heated to a temperature in a range of 400° C. to 490° C. and soaked at this temperature for a period of 3 sec. to 10 min. and then rapidly cooled or quenched.

5. Method according to claim 1, wherein the whole aluminium alloy sheet within 10 hours prior to forming in step b. has been heated to a temperature in a range of 450° C. to 480° C. and soaked at this temperature for a period of 3 sec. to 10 min. and then rapidly cooled or quenched.

6. Method according to claim 1, wherein the aluminium alloy sheet has been artificially aged to a yield strength of 500 MPa or more prior to forming in step b.

7. Method according to claim 1, wherein the rolled aluminium sheet product has a core layer of the aluminum alloy and a clad layer on at least one side of the core layer.

8. Method according to claim 1, wherein the aluminium sheet product has been artificially aged to a yield strength of at least 540 MPa, prior to forming in step b.

9. The method according to claim 1, wherein the aluminium alloy sheet has a Zr-content in a range of 0.07% to 0.18%.

10. The method according to claim 1, wherein the aluminium alloy has a Zn content in a range of 6.9% to 7.8%.

11. The method according to claim 1, wherein the aluminium alloy has a Mg content in a range of 1.4% to 2.1%.

12. The method according to claim 1, wherein the aluminium alloy has a Si content in a range of 0.1% to 0.25% and has a Fe content in a range of 0.1% to 0.25%.

13. The method according to claim 1, wherein the aluminium sheet product comprises a layer of the aluminium alloy having a gauge in the range of 0.5 to 4 mm.

14. The method according to claim 1, wherein the aluminium alloy has a Cr content in a range of 0.05% to 0.25% and an absence of Zr.

15. The method according to claim 7, wherein each said clad layer consists of an AA5xxx-series alloy having more than 3.8 wt. % Mg, wherein each said clad layer has a thickness in a range of 2% to 30% of the thickness of the core layer.

16. The method according to claim 7, wherein each said clad layer is an AA5xxx-series alloy having, in wt. %:

Mg 3.8% to 7.0%,
Zn 0.6% to 2.8%,
Mn 0 to 1.0%,
Cu 0 to 2.0%,
optionally at least one element selected from the group consisting of: Zr 0.04 to 0.3%, Cr 0.04 to 0.3%, Hf 0.04 to 0.3%, and Ti. 0.01 to 0.2%,
Fe max. 0.3%,
Si max. 0.3%,
inevitable impurities,
balance aluminium, and
wherein the range for the Zn-content is a function of the Mg-content according to:
lower-limit of the Zn-range: [Zn]=0.34 [Mg]−0.4, and
upper-limit of the Zn-range: [Zn]=0.34 [Mg]+0.4,
wherein each said clad layer has a thickness in a range of 2% to 30% of the thickness of the core layer.

* * * * *